US006750601B2

(12) United States Patent
Kim

(10) Patent No.: US 6,750,601 B2
(45) Date of Patent: Jun. 15, 2004

(54) ELECTRON GUN FOR COLOR CATHODE RAY TUBE

(75) Inventor: Youn Jin Kim, Gumi-si (KR)

(73) Assignee: LG Philips Displays Korea Co., Ltd., Gyeongsangbuk-do (KR)

( * ) Notice: Subject to any disclaimer, the term of this patent is extended or adjusted under 35 U.S.C. 154(b) by 0 days.

(21) Appl. No.: 10/157,815

(22) Filed: May 31, 2002

(65) Prior Publication Data

US 2003/0111952 A1 Jun. 19, 2003

(30) Foreign Application Priority Data

Sep. 14, 2001 (KR) ..... 2001-56933

(51) Int. Cl.[7] ..... H01J 29/50
(52) U.S. Cl. ..... 313/414
(58) Field of Search ..... 313/409, 412, 313/414, 425, 441, 442; 315/14, 15, 382, 382.1

(56) References Cited

U.S. PATENT DOCUMENTS 4,124,810 A * 11/1978 Bortfeld et al. ..... 315/15
4,178,532 A * 12/1979 Fukuzawa et al. ..... 313/414
4,498,028 A * 2/1985 Gorski ..... 315/15
4,737,682 A * 4/1988 Alig et al. ..... 313/414
5,936,337 A * 8/1999 Toujou et al. ..... 313/414
6,031,326 A * 2/2000 Suzuki et al. ..... 313/414

FOREIGN PATENT DOCUMENTS

| | | |
|---|---|---|
| JP | 55-146847 | 11/1980 |
| JP | 11-135031 | 5/1999 |
| WO | 99/01884 | 1/1999 |

* cited by examiner

*Primary Examiner*—Sandra O'Shea
*Assistant Examiner*—Peter Macchiarolo
(74) *Attorney, Agent, or Firm*—Birch, Stewart, Kolasch & Birch, LLP

(57) ABSTRACT

An electron gun for a color cathode ray tube efficiently modulates magnetic field of a velocity modulation coil. The electron gun contains at least two focus electrodes receiving a fixed focus voltage, and the focus electrodes are arranged in a row in the electron gun. When a sum of lengths of the focus electrodes is 'L' and a sum of intervals of the electrodes is 'g', the relationship (g×100)/L=5–30(%) is satisfied.

4 Claims, 5 Drawing Sheets

-Related Art-

-Related art-

-Related Art-

< Coil operation principle >

-Related Art-

-Related Art-

ELECTRON GUN FOR COLOR CATHODE RAY TUBE

This application claims priority under 35 U.S.C. §119 of Korea 56933/2001, filed Sep. 14, 2001, the entire contents of which are hereby incorporated by reference.

BACKGROUND OF THE INVENTION

1. Field of the Invention

The invention relates to an electron gun for a color cathode ray tube (CRT), and in particular to an electron gun for a color CRT having an improved electrode structure and shape in order to reduce a spot diameter influencing the electron beam focus.

2. Description of the Related Art

FIG. 1 is a schematic structure view illustrating a related CRT.

Referring to FIG. 1, a multiple electrodes are formed on an in-line electron gun for the CRT. The multiple electrodes are positioned at predetermined intervals in a vertical direction to a path of an electron beam 13, so that the electron beam 13 generated in cathodes 3 can reach a screen 17 at a predetermined strength.

In detail, the multiple electrodes include a first electrode 4 which is a common lattice of three cathodes 3, a second electrode 5 arranged at a predetermined interval from the first electrode 4, a third electrode 6, a fourth electrode 7, a fifth electrode 8 and a sixth electrode 9.

In addition, a shield cup 10 having a BSC (Bulb Space Contactor) 11 for electrically connecting the electron gun to the tube and fixing the electron gun to a neck unit of the tube is formed on the sixth electrode 9.

The operation of the electron gun will now be explained. In the electron gun, electrons are emitted from stem pins 1 by a heater 2 of the cathode 3. The electron beam 13 is controlled by the first electrode 4 which is a control electrode, accelerated by the second electrode 5 which is an accelerating electrode, and partially focused and accelerated by a full space focus lens formed among the second electrode 5, the third electrode 6, the fourth electrode 7 and the fifth electrode 8.

The electron beam is mostly focused and accelerated by the sixth electrode 9 which is synchronized with a deviation signal to form a quadrupole lens for compensating for astigmatism generated by a deflection yoke, which receives a variable voltage and which is a main lens formation electrode called a focus electrode, and the seventh electrode 10 which is an anode electrode. The focused electron beam 14 passes through a shadow mask 15 formed inside a fluorescent surface 16, and collides with the fluorescent surface 16, to emit light.

The deflection yoke 12 for deviating the electron beam 13 emitted from the electron gun to the whole surface of the screen 17 is positioned outside the electron gun, thereby embodying the screen.

A velocity modulation (VM) coil 18 synchronized with an image signal of a circuit is formed on the neck unit of the CRT having the related electron gun. In one major aspect of the invention, the VM coil 18 is used to reduce the spot diameter.

In design properties of the electron gun, a lens magnification, a space charge repulsive force and a spherical aberration of a main lens influence the spot diameter of the screen.

Such properties will now be explained in more detail.

The variation of the spot diameter $D_x$ due to the lens magnification is rarely used as a design factor of the electron gun and less effective, since basic voltage conditions, a focal distance and a length of the electron gun are previously determined.

The space charge repulsive force is a spot diameter magnification phenomenon resulting from repulsion and collision of electrons of the electron beam. In order to restrict magnification of the spot diameter $D_{st}$ due to the space charge repulsive force, a progressing angle of the electron beam (hereinafter, referred to as 'divergence angle'; $\alpha$) is preferably set up to be increased.

In the spherical aberration property of the main lens, the spot diameter $D_{1c}$ is magnified due to difference in the focal distance between electrons passing through a radical axis of the lens and electrons passing through a protaxis thereof. Oppositely to the space charge repulsive force, when the divergence angle of the electron beam incident on the main lens is decreased, the spot diameter is embodied small on the screen.

As explained above, the spot diameter $D_t$ on the screen is represented by the following formula as adding up of three factors:

$$D_t = \sqrt{(D_x + D_{st})^2 + D_{1c}^2}$$

Especially, a method for magnifying a diameter of a main lens has been suggested to reduce the space charge repulsive force and the spherical aberration.

Since the diameter of the main lens is magnified, if an electron beam having a large divergence angle is incident, magnification of the spots due to the spherical aberration is restricted, and the space charge repulsive force after passing through the main lens unit is decreased, thereby embodying small spots on the screen.

FIG. 2 is an experimental result showing variations of the spot diameter by the main lens diameter.

As shown in the graph of FIG. 2, when the diameter of the main lens is increased, the magnification of the spot diameter due to the spherical aberration of the main lens is restricted, thereby reducing the spot diameter on the screen.

Generally, the fifth electrode receiving a high voltage and the sixth electrode synchronized with the deviation signal for receiving a variable voltage are called focus electrodes. A length of the focus electrode is an important factor for determining a voltage ratio (%: focus/high voltage) of the electron gun. Here, the sixth electrode is used to compensate for astigmatism of the deflection yoke. When it is not necessary to improve resolution and clearness of a peripheral screen unit, the sixth electrode may not be employed.

A method for mechanically magnifying a hole diameter of a main lens formation electrode and a method for increasing a depth of an electrostatic field control electrode for correcting a lens have been taught as methods for magnifying a main lens unit.

It is almost impossible to mechanically increase the hole diameter of the electrode due to $\phi$29.1 mm of a neck diameter, and thus difficult to improve quality of focus.

Accordingly, a circuit of a chassis driving the CRT is appropriately controlled to reduce the spot diameter on the screen and improve resolution, so that a differential signal of an image signal for scanning the electron beam to the screen is synchronized with the coil of the neck unit of the CRT having the electron gun, and the electron beam is evenly modulated in a deviation speed by a deviation magnetic field of the deflection yoke. As a result, resolution and-clearness of the screen are improved.

FIG. 3 is a schematic view illustrating an operation principle of the VM coil.

In order to optimize the method for improving resolution on the circuit, a whole length of the electrode receiving a fixed focus voltage must be sufficiently short, and an interval must be sufficiently prepared so that a speed modulation magnetic field due to current synchronized with the image signal of the coil can be efficiently penetrated thereinto.

The structure of the related electron gun is not suitable to maximize the effect of the coil.

In general, a center of the magnetic field generated by the coil is positioned adjacently to the fifth electrode receiving a relatively high voltage. A length of the electrode is increased for the required voltage ratio in design.

As compared with alignment of small components, to increase the length of the electrode can cut down production expenses and simplify a production process.

However, the structure of the electron gun by the simplified long electrode deteriorates speed modulation effects due to the magnetic field of the coil, thus restricting improvement of the resolution.

SUMMARY OF THE INVENTION

It is, therefore, an object of the present invention to provide an electron gun which can maximize an operation of a VM coil synchronized with a differential signal of an image signal, by arranging at least two focus electrodes receiving a fixed focus voltage in a row among main electrodes including an anode electrode and cathode electrodes, and by maintaining an appropriate interval between the focus electrodes receiving the fixed focus voltage.

To achieve the above object, in a cathode ray tube having a cathode for emitting an electron beam to a fluorescent screen, an electron gun having an anode electrode of a screen side and focus electrodes of a cathode side, and a VM coil using a position of the focus electrode as a center of a magnetic field, being positioned on a neck unit of the cathode ray tube, and being synchronized with an image signal of a circuit, the electron gun including at least two focus electrodes of main electrodes receiving a fixed focus voltage, wherein, when a sum of lengths of the focus electrodes is 'L' and a sum of intervals of the electrodes is 'g', '$(g\times100)/L=5\sim30(\%)$' is satisfied.

In one aspect of the present invention, resolution of the screen is improved by minimizing a screen spot diameter by 15 to 30% in a horizontal direction.

BRIEF DESCRIPTION OF THE DRAWINGS

The above objects, features and advantages of the present invention will become more apparent from the following detailed description when taken in conjunction with the accompanying drawings, in which.

DETAILED DESCRIPTION

Figure 1:
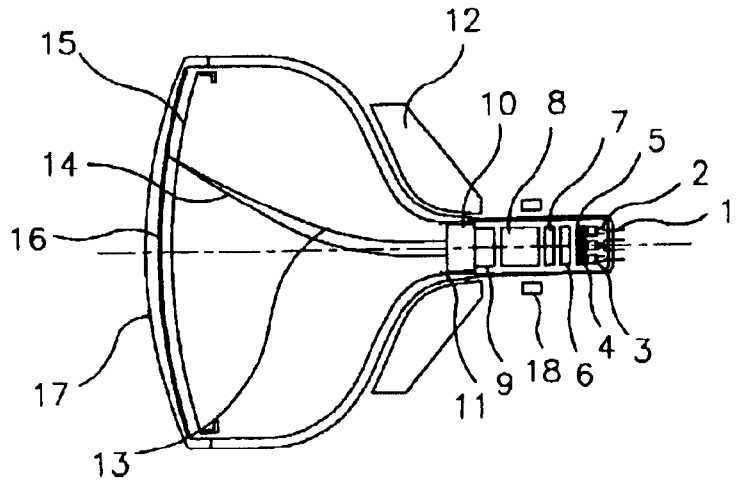
FIG. 1 is a schematic view illustrating a general CRT.
Figure 2:
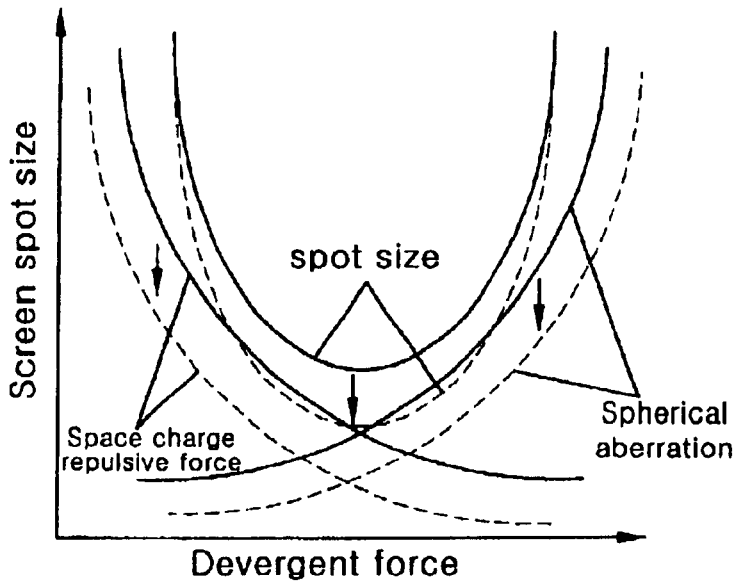
FIG. 2 is a graph showing variations of a spot diameter by a main lens diameter.
Figure 3:
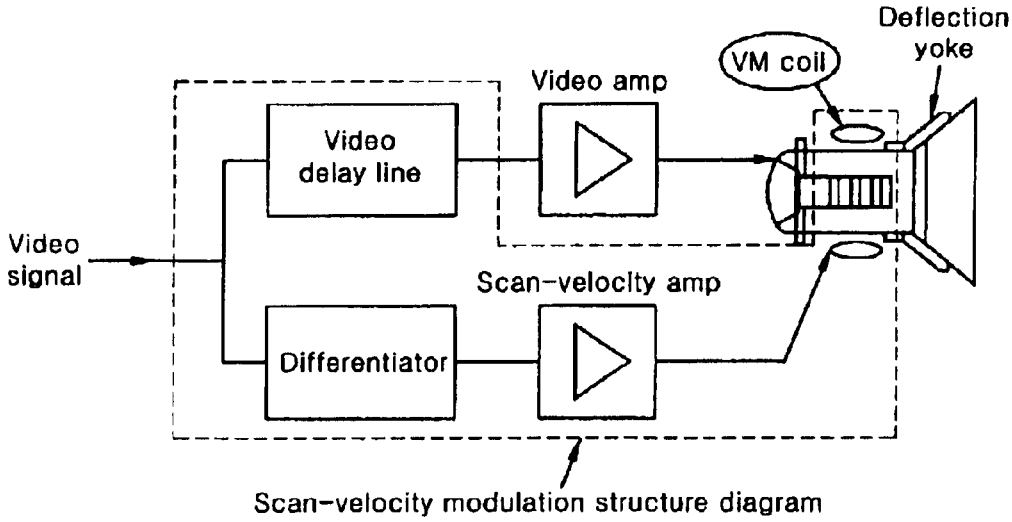
FIG. 3 is a view illustrating an operation principle of a VM coil.
Figure 3:
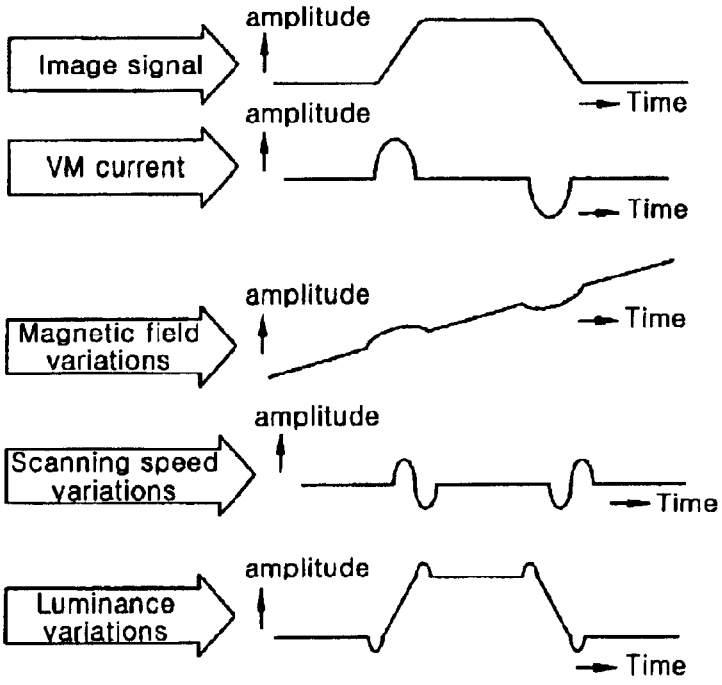

The invention will now be described with reference to the accompanying drawings. In the following description, the same drawing reference numerals are used for the same elements even in different drawings. The matters defined in the description giving a detailed construction and elements of a circuit are nothing but the ones provided to assist in a comprehensive understanding of the invention. Thus, the invention can be carried out without those defined matters. Also, well-known functions or constructions are not described in detail since they would obscure the invention with unnecessary detail.

In order to optimize a method for improving resolution of a VM coil, a length of a focus electrode in which a center of a magnetic field generated by the VM coil is positioned and which receives a fixed focus voltage must be increased for a high voltage ratio. In addition, an interval of electrodes must be sufficiently prepared so that a speed modulation magnetic field due to current synchronized with an image signal of the VM coil can be efficiently penetrated thereinto.

Similarly to the related electron gun of FIG. 1, an electron gun main lens structure of the prevent invention includes electrodes having an opening unit commonly used for three electron beams, a plate-shaped electrostatic field control electrode having three electron beam passing holes, and a plurality of cap-shaped stacked electrodes. The plurality of electrodes are electrically connected by a welding process, for receiving a high voltage and a variable voltage synchronized with a deviation signal.

In the main electrodes including an anode electrode of a screen side and focus electrodes of a cathode side, the focus electrodes are divided into an electrode applying a variable focus voltage and electrodes applying a fixed focus voltage.

At least two focus electrodes applying the fixed focus voltage are provided.

Figure 4A:
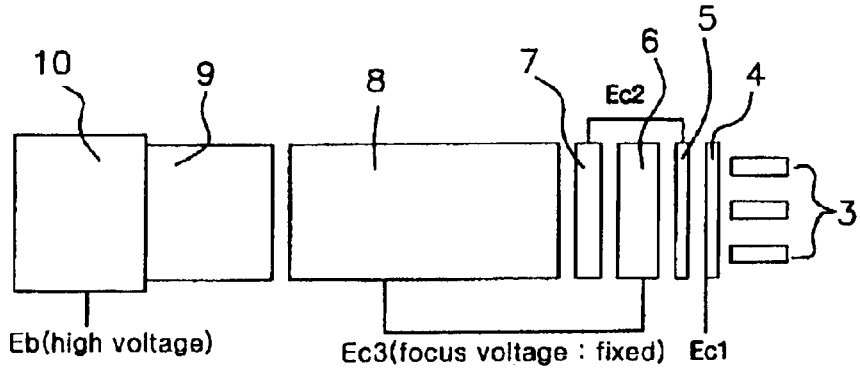
FIGS. 4*a* to 4*d* are structure views illustrating a related electron gun and an electron gun in accordance with the present invention.
Figure 4B:
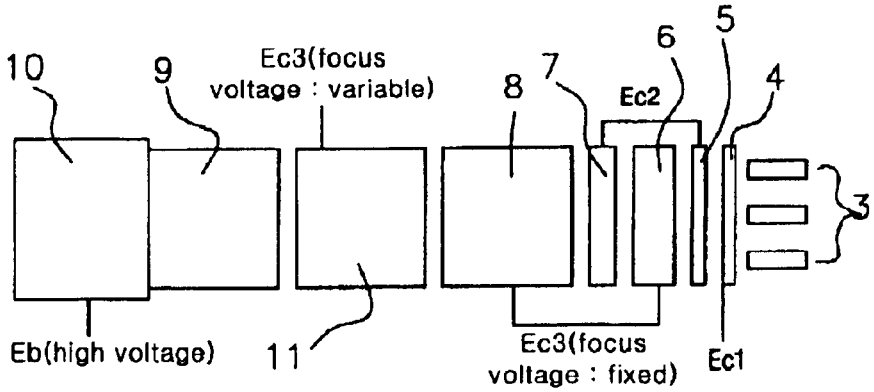
Figure 4C:
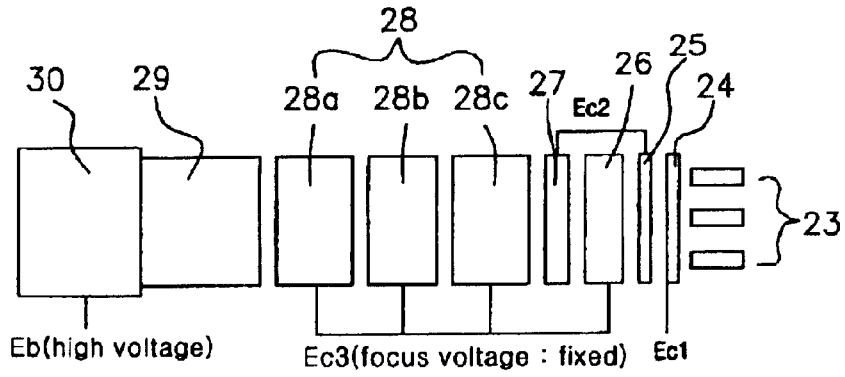

FIGS. 4*a* and 4*b* are structure views illustrating a related electron gun, and FIG. 4*c* is a structure view illustrating an electron gun where the focus electrodes 28 receiving the fixed focus voltage are arranged in a row in accordance with the present invention.

Figure 4D:
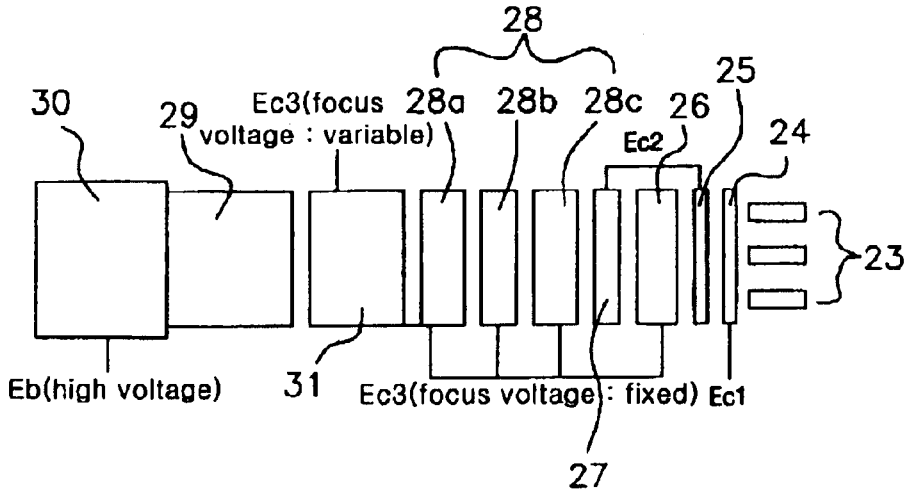

FIG. 4*d* is a structure view illustrating the electron gun in accordance with the present invention. In the electron gun, the focus electrode 31 receiving the variable focus voltage and the focus electrodes 28 receiving the fixed focus voltage are arranged in a row.

Cathodes 23 receiving an image signal, a second electrode 25 collecting electrons emitted from the cathodes 23 and enabling the electrons to go toward the screen, and a first electrode 24 for preventing emission of the electrons when a voltage corresponding to an image signal for applying the electron beam to the cathode is not transmitted are arranged in the electron gun of FIG. 4*c*. In addition, a third electrode 26 for applying a relatively high voltage, a fourth electrode 27 for applying a relatively low voltage, and focus electrodes 28*a*, 28*b* and 28*c* for applying a relatively high fixed voltage are also arranged therein.

The main lens is formed to scan the electron beam to the screen by a ninth electrode 29 receiving a high voltage. A shield cup 30 electrically connects the electron gun to the tube (not shown).

As compared with the electron gun of FIG. 4*c*, the electron gun of FIG. 4*d* further includes an eighth electrode 31 for forming a quadrupole lens synchronized with a deviation signal of a deflection yoke, for applying the variable focus voltage and compensating for astigmatism generated by a deflection yoke magnetic field.

The main lens is formed to scan the electron beam to the screen by the eighth electrode 31 and the ninth electrode 29 receiving the high voltage, thereby forming the screen of the CRT.

Figure 6A:
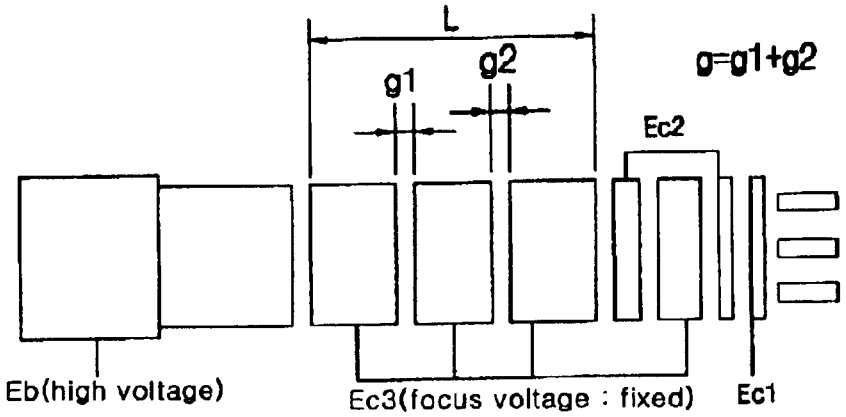
FIG. 6*a* is a structure view illustrating the electron gun in accordance with the present invention.
Figure 6B:
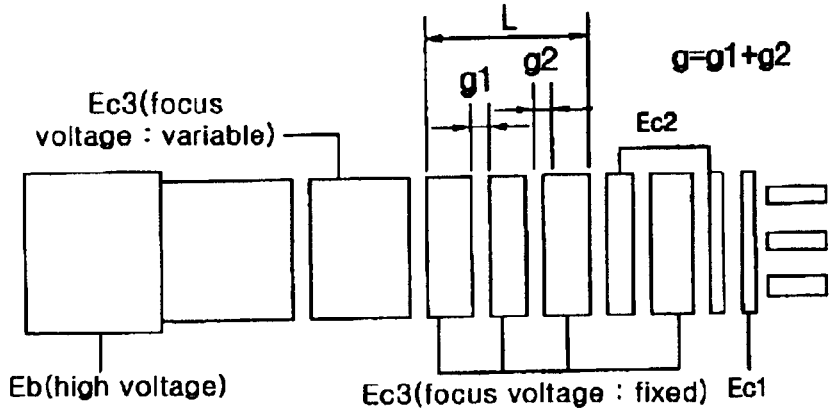
FIG. 6*b* is a structure view illustrating the electron gun including an electrode for applying a variable focus voltage in accordance with the present invention.

FIG. 6 is a structure view illustrating the electron gun including the focus electrode for applying the fixed focus voltage in accordance with the present invention.

The main electrodes include the anode electrode 29 and the focus electrodes 28. The focus electrodes 28 are composed of the electrode 31 for applying the variable focus voltage, and the electrodes 28 for applying the fixed focus voltage.

Identically to the focus electrodes 28*a*, 28*b* and 28*c* of FIGS. 4*c* and 4*d*, at least two focus electrodes 28 for applying the fixed focus voltage are arranged in a row. A sum (L) of the length of the focus electrodes 28 ranges from 4 mm to 30 mm.

Here, when it is presumed that a sum of the intervals g1 and g2 of the focus electrodes 28 is 'g', '(g×100)/L=5~30 (%)' is satisfied.

Figure 5A:
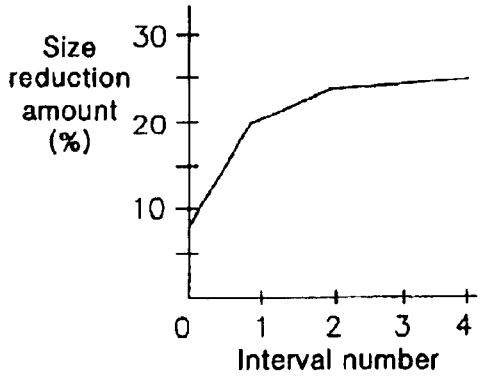
FIGS. 5*a* to 5*c* are graphs showing variations of a spot diameter by focus electrodes receiving a fixed focus voltage and a coil synchronized with a differential signal of an image signal.
Figure 5B:
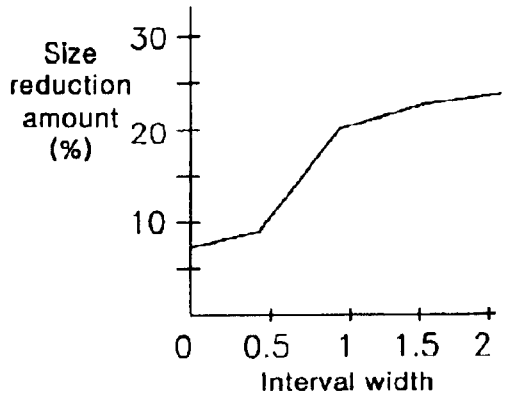
Figure 5C:
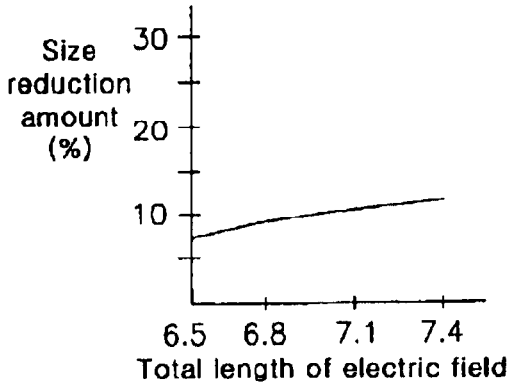

Experimental results for the focus electrodes 28 for receiving the fixed focus voltage and satisfying the above formula are shown in graphs of FIGS. 5*a* to 5*c*.

FIGS. 5*a* to 5*c* show variations of the spot diameter by the focus electrodes receiving the fixed focus voltage and the coil synchronized with a differential signal of an image signal.

FIG. 5*a* is a graph showing a number of the intervals of the electron gun electrodes, especially the focus electrodes being positioned at the center of a coil operation magnetic field, and receiving the fixed focus voltage, namely a number of the intervals of the fifth electrode 28*a*, the sixth electrode 28*b* and the seventh electrode 28*c* of FIG. 4, and a reduction amount of the screen spot due to a speed modulation magnetic field of the coil. The more the number of the intervals is increased, the better effects are obtained.

FIG. 5*b* is a graph showing a length of the intervals of the focus electrodes 28 and the reduction amount of the screen spot due to the speed modulation magnetic field of the coil. When the length of the intervals ranges from about 0.6 to 1.2 mm, the operation of the coil is maximized.

FIG. 5*c* is a graph showing relation of a total length of the electron gun and the speed modulation magnetic field of the coil. The electron gun inserted into the CRT has a proportional period.

According to the data of FIGS. 5*a* to 5*c*, the number of the intervals of the focus electrodes 28 is at least one, and the length of the intervals preferably ranges from 0.6 to 1.2 mm. Although the long total length of the electron gun is advantageous, it is not effective over a predetermined level.

When a sample is produced and measured under the above conditions, the size of the spots on the screen can be reduced by about 15 to 30% in a horizontal direction.

In accordance with the invention, in order to reduce the spot diameter to remarkably influence the focus, the whole length of the focus electrode receiving the fixed focus voltage is maintained as it is, the focus electrode is divided into at least two electrodes to apply an identical voltage, and the intervals of the focus electrodes range from 0.6 to 1.2 mm, thereby reducing the spot diameter on the screen by 15 to 30% in the horizontal direction.

Moreover, the electron gun can be applied with small expenses and short period, to improve quality of the focus in advance.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A cathode ray tube, which comprises:

a fluorescent screen;

a cathode for emitting an electron beam to the fluorescent screen;

an electron gun having an anode electrode on a screen side and at least two focus electrodes receiving a fixed focus voltage on a cathode side; and a velocity modulation coil using a position of the focus electrode as a center of a magnetic field, the velocity modulation coil being positioned on a neck unit of the cathode ray tube, and the velocity modulation coil being synchronized with an image signal of a circuit, wherein the electron gun satisfies the relationship:

$$(g\times 100)/L=5\text{–}30(\%)$$

where L is a sum of lengths of the focus electrodes and g is a sum of lengths of intervals of the focus electrodes.

2. The cathode ray tube of claim 1, wherein L is between 4 mm and 30 mm.

3. The cathode ray tube of claim 1, wherein g is between 0.6 mm and 1.2 mm.

4. The cathode ray tube of claim 1, wherein there are three focus electrodes.

* * * * *